US007014311B2

(12) United States Patent
Kobayashi et al.

(10) Patent No.: US 7,014,311 B2
(45) Date of Patent: Mar. 21, 2006

(54) INK-JET RECORDING SHEET AND METHOD FOR PREPARING THE SAME

(75) Inventors: Takashi Kobayashi, Shizuoka-ken (JP); Kazuyuki Koike, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 176 days.

(21) Appl. No.: 10/699,912

(22) Filed: Nov. 4, 2003

(65) Prior Publication Data

US 2004/0096599 A1 May 20, 2004

(30) Foreign Application Priority Data

Nov. 15, 2002 (JP) ..... 2002-331750

(51) Int. Cl.
*B41J 2/01* (2006.01)
*B41M 5/00* (2006.01)

(52) U.S. Cl. ..... 347/102; 347/105; 428/32.1

(58) Field of Classification Search ..... 347/105, 347/102, 101; 428/32.1, 195
See application file for complete search history.

(56) References Cited

U.S. PATENT DOCUMENTS 6,777,039 B1 * 8/2004 Koike et al. ..... 428/32.26
2002/0094420 A1 7/2002 Hatano et al.
2002/0115773 A1 8/2002 Katoh et al.
2003/0068476 A1 * 4/2003 Yamada et al. ..... 428/195
2003/0104175 A1 * 6/2003 Koike et al. ..... 428/195

FOREIGN PATENT DOCUMENTS

| | | | |
|---|---|---|---|
| EP | 1 251 013 | A2 | 10/2002 |
| JP | 2000-211235 | A | 8/2000 |
| JP | 2001-334742 | A | 12/2001 |
| JP | 2002-172850 | A | 6/2002 |
| JP | 2002-192830 | A | 7/2002 |
| JP | 2002-274013 | A | 9/2002 |

* cited by examiner

*Primary Examiner*—Manish Shah
*Assistant Examiner*—Leonard Liang
(74) *Attorney, Agent, or Firm*—Sughrue Mion, PLLC

(57) ABSTRACT

The present invention provides a method for preparing an ink-jet recording sheet including a support and a colorant receiving layer disposed on the surface of the support, and an ink-jet recording sheet prepared by the method. The method including: coating a coating solution including inorganic fine particles, a water-soluble resin and a boron compound on the surface of the support to form a coated layer; and cross-linking and hardening the coated layer to form a colorant receiving layer. The cross-linking and hardening is performed by applying a solution containing a metal compound and having a pH of 8 or higher to the coated layer or a coated film at one of: (1) simultaneous as coating the coating solution; (2) during drying of the coated layer and before the coated layer shows a falling rate of drying; or (3) after the coated layer is dried to form the coated film.

1 Claim, No Drawings

INK-JET RECORDING SHEET AND METHOD FOR PREPARING THE SAME

CROSS-REFERENCE TO RELATED APPLICATIONS

This application claims benefit of and priority to Japanese Patent Application No. 2002-331750, filed on Nov. 15, 2002, which is incorporated herein by reference in its entirety for all purposes.

BACKGROUND OF THE INVENTION

1. Field of the Invention

The present invention relates to a recording material suitable for ink-jet recording using a liquid ink such as an aqueous ink, an oil-based ink, and a solid ink which is solid at a normal temperature and is subjected to printing by being melted and liquefied, and method for preparing the same. More particularly, the present invention relates to an ink-jet recording sheet excellent in ink receiving ability, and method for preparing the same.

2. Description of the Related Art

Recently, with rapid development of information industries, various information processing systems have been developed, and recording methods and apparatuses suitable for these information systems also have been developed, and all of these have been put into practice.

Among the aforementioned recording methods, an ink-jet recording method come to be widely used, in offices and for home-use since many kinds of recording materials can be recorded thereby, and hardware (apparatuses) thereof is relatively inexpensive and compact, and quietness thereof is excellent.

In addition, with recent enhancement of resolution of ink-jet printers, it has also become possible to obtain "photorealistic" high image quality recorded materials. Additionally, with development of hardware (apparatuses), various types of recording sheets for ink-jet recording have been developed.

Properties required for the aforementioned recording sheets for ink-jet recording are generally (1) quick-drying (high ink absorbing rate), (2) appropriate and uniform diameter of ink dots (no blurring), (3) good granularity, (4) high complete-roundness of dots, (5) high color density, (6) high chroma (no dullness), (7) good light fastness, gas resistance and water resistance of printed portions, (8) high whiteness of a recording sheet, (9) good shelf stability of a recording sheet (no occurrence of yellowing coloration by long term storage, no blurring of an image by long term storage), (10) little deformation, and good dimensional stability (sufficiently small curling), (11) good hardware running properties, and the like. For utilizing a photographic glossy paper used for the purpose of obtaining the photorealistic high image quality recorded material, in addition to the aforementioned properties, glossiness, surface smoothness, photographic paper-like texture similar to that of a silver salt photograph and the like are also required.

As an ink-jet recording sheet satisfying the aforementioned requirements, there are known a sheet, in which a solution containing inorganic fine particles, a mordant, a water-soluble resin such as PVA, and a hardener for the water-soluble resin is coated on a support to form a colorant receiving layer (for example, the following Japanese Patent Application Laid-Open (JP-A) No. 12-211235 (paragraph 0055–0057)), and a sheet, in which a solution containing inorganic fine particles, a metal compound, and a water-soluble resin such as PVA is coated on a support and, before complete drying of a coated layer, a solution containing a hardener for the water-soluble resin is applied to the coated layer to form a colorant receiving layer (for example, see the following JP-A No. 2001-334742).

The colorant receiving layer in the ink-jet recording sheet described in JP-A No. 12-211235 (paragraph 0055–0057) is obtained by coating and drying a coating solution containing gas phase method silica, a cationic polymer having a structural unit of a polydiallylamine derivative (dimethyldiallylammonium chloride polymer), PVA and boric acid, however, with this ink-jet recording sheet printing density and glossiness of an image is low.

The colorant receiving layer in an ink-jet recording sheet of JP-A No. 2001-334742 is a layer obtained by coating a coating solution including inorganic fine particles (e.g. gas phase method silica having an average primary particle diameter of 20 nm or less), a water-soluble resin (e.g. PVA) and an at least divalent water-soluble metal salt on a support and, at the same time as coating, or before the coated layer shows a falling rate of drying, applying a solution containing a cross-linking agent which can cross-link the water-soluble resin (e.g. borax or boric acid) to harden the layer. Thus obtained colorant receiving layer can prevent cracking, however there was a problem that the printing density of an image is low, and the stability of the coating solution containing the water-soluble metal salt is not sufficient.

As a mordant for fixing a dye in an ink receiving layer, there is known an inorganic mordant such as a polyvalent metal salt (for example, see the following JP-A Nos. 2002-172850 or 2002-274013) in addition to the cationic polymer described in the aforementioned JP-A No. 12-211235 (paragraphs 0055–0057).

An ink receiving layer in JP-A No. 2002-172850 contains inorganic fine particles, polyvinyl alcohol, at least two kinds of a cationic polymer having a quaternary ammonium base, and a compound having a zirconium or aluminium atom (except for zirconium oxide and aluminium oxide) in a molecule, and reduces blur and improves water resistance of a water-soluble dye during storage after printing without deteriorating bronzing.

In addition, a colorant receiving layer in JP-A No. 2002-192830 is characterized in that it contains polyvinyl alcohol, a cationic polymer, and a compound having a zirconium or aluminium atom (except for zirconium oxide and aluminium oxide), and a film surface pH of the surface of the ink receiving layer after printing with an ink-jet printer is 4 to 6, and reduces blur and improves water resistance of a water-soluble dye during storage after printing without deteriorating bronzing.

Further, a colorant receiving layer in JP-A No. 2002-274013 contains inorganic fine particles, a hydrophilic binder, a compound A containing a zirconium atom or an aluminium atom (except for zirconium oxide and aluminium oxide) in a molecule, and a compound B which is different from the compound A and contains a polyvalent metal atom in a molecule, at 0.1 to 10 mole % of the compound A, and suppresses occurrence of blur and improves the water resistance of an image when a printed image using a water-soluble dye is stored, without deteriorating bronzing.

When an ink receiving layer is formed according to the same manner as that of JP-A No. 2001-334742 using this inorganic mordant described in JP-A No. 2002-172850 or JP-A No. 2002-274013, cracks do not occur in the ink receiving layer, however sufficient glossiness and printing density can not be obtained. Further, stability of a solution is not improved.

SUMMARY OF THE INVENTION

The present invention has been achieved in view of the aforementioned problems, and can provide an ink-jet recording sheet, in which cracking or the like does not occur in a colorant receiving layer, is rigid and, is excellent in printing density and glossiness of an image, and has no blurring of images with time, and a method for preparing the same.

That is, one aspect of the invention provides a method for preparing an ink-jet recording sheet including a support and a colorant receiving layer disposed on the surface of the support, the method comprises:

coating a coating solution including inorganic fine particles, a water-soluble resin and a boron compound on the surface of the support to form a coated layer; and cross-linking and hardening the coated layer to form a colorant receiving layer;

wherein the cross-linking and hardening is performed by applying a solution containing a metal compound and having a pH of 8 or higher to the coated layer or a coated film at a time selected from the following:

(1) at the same time as coating the coating solution;

(2) during drying of the coated layer formed by coating the coating solution and before the coated layer shows a falling rate of drying; or (3) after the coated layer formed by coating the coating solution is dried to form the coated film.

Another aspect of the invention provides the aforementioned method characterized in that the metal compound is a zirconium compound.

Still another aspect of the invention provides the aforementioned method characterized in that the inorganic fine particles are gas phase method silica having an average primary particle diameter of 20 nm or smaller, and the water-soluble resin is polyvinyl alcohol.

Further, the invention provides an ink-jet recording sheet formed by the aforementioned method.

DETAILED DESCRIPTION OF THE INVENTION

Ink-jet Recording Sheet

The ink-jet recording sheet of the present invention is an ink-jet recording sheet having a colorant receiving layer disposed on the surface of a support, and characterized in that the colorant receiving layer is a layer obtained by cross-linking and hardening a coating solution including inorganic fine particles, a water-soluble resin and a boron compound (hereinafter, referred to as "first coating solution" in some cases) on the surface of the support, and the cross-linking and hardening is performed by applying a solution containing a metal compound and having a pH of 8 or higher (hereinafter, referred to as "second coating solution" in some cases) to the coated layer or the coated film at a time selected from the following: (1) at the same time as coating the coating solution; (2) during drying of the coated layer formed by coating the coating solution and before the coated layer shows a falling rate of drying; or (3) after the coated layer formed by coating the coating solution is dried to form the coated film.

By applying a solution containing a metal compound and having a pH of 8 or higher to cross-link and harden a coated layer to form a colorant receiving layer after a first coating solution containing a boron compound is coated, the ink-jet recording sheet of the invention causes no occurrence of cracking and is firm and, additionally, has less blur with time, and can improve the printing density and the glossiness of an image. In addition, the light fastness is further improved as compared with the case where an organic polymer mordant such as polyallylamine is added to a second coating solution.

Colorant Receiving Layer

First, each material contained in a colorant receiving layer is explained. The colorant receiving layer in the invention contains at least inorganic fine particles, a water-soluble resin, a boron compound and a metal compound and, if necessary, a cationic resin, a surfactant, a mordant and the like.

Inorganic Fine Particles

Examples of the inorganic fine particles include gas phase method silica, hydrous silica fine particles, colloidal silica, titanium dioxide, barium sulfate, calcium silicate, zeolite, kaolinite, halloysite, mica, talc, calcium carbonate, magnesium carbonate, calcium sulfate, boehmite, pseudoboehmite and the like. These may be used alone or in combination thereof. It is preferable that the inorganic fine particles are used by dispersing with a cationic resin.

As the inorganic fine particles, gas phase method silica is preferable and, when the gas phase method silica is used with other inorganic fine particles in combination, an amount of the gas phase method silica in the entire inorganic fine particles are preferably at least 90% by mass, further preferably at least 95% by mass.

Here, silica fine particles are usually classified roughly into wet particles and dry (gas phase) particles depending on A method for preparing particles. In the wet method, there is a main method of producing active silica by acid degradation of silicate, and polymerizing this suitably, followed by aggregation and settling to obtain hydrous silica. On the other hand, in a gas phase method, there are main methods of obtaining anhydrous silica such as a method of gas phase-hydrolyzing silica halide at a high temperature (flame hydrolyzing method), and a method of heating, reducing and volatilizing silica sand and coke with arc in an electric furnace, and oxidizing this with the air (arc method), and the "gas phase method silica" means anhydrous silica fine particles obtained by the gas phase method.

The aforementioned gas phase method silica is different from the aforementioned hydrous silica in a density of a silanol group on the surface, the presence or the absence of a bubble, and the like, exhibits the different nature, and is suitable for forming a three-dimensional structure having a high porosity. The reason is not clear, however it is presumed that, in the case of hydrous silica, a density of a silanol group on the surface of fine particles are high as 5 to 8 groups/nm$^2$, and silica fine particles are easily aggregated (aggregate) densely, on the other hand, in the case of gas phase method silica, a density of a silanol group on the surface of fine particles are low as 2 to 3 groups/nm$^2$, therefore, a coarse soft aggregate (flocculate) is formed and, as a result, a structure having a high porosity is formed.

Since the aforementioned gas phase method silica has a particularly large specific surface area, the absorbing property and retaining property efficiency of an ink is high and, since the silica has a low refractive index, when dispersed to appropriate particle diameter, transparency can be applied to a colorant receiving layer, and the high color density and the better developing property are obtained. Transparency of the colorant receiving layer is important from the viewpoint of obtaining the high color density and the better developable glossy, not only in utilities requiring transparency such as OHP, but also in application to a recording sheet such as a photoglossy paper.

An average primary particle diameter of the gas phase method silica is preferably 20 nm or smaller, more preferably 10 nm or smaller, most preferably 3 to 10 nm. Since in the gas phase method silica, particles are easily attached to each other by a hydrogen bond due to a silanol group, a structure having a great porosity can be formed when an average primary particle diameter is 20 nm or smaller.

Water-soluble Resin

Examples of the water-soluble resin include polyvinyl alcohol (PVA), polyvinyl acetal, cellulose type resin (for example, methylcellulose (MC), ethylcellulose (EC), hydroxyethylcellulose (HEC), and carboxymethylcellulose (CMC)), chitins, chitosans, starch; polyethylene oxide (PEO), polypropylene oxide (PPO), polyethylene glycol (PEG) and polyvinyl ether (PVE) which are resins having an ether linkage; polyacrylamine (PAAM) and polyvinylpyrrolidone (PVP) which are resins having an amido group or an amido linkage, as well as polyacrylic acid salt, maleic acid resin, alginic acid salt, gelatins and the like which have a carboxyl group as a dissociable group. These may be used alone or in combination thereof.

Among them, polyvinyl alcohol is preferable and, when the polyvinyl alcohol and other water-soluble resin are used in combination, an amount of the polyvinyl alcohol in the entire water-soluble resin is preferably at least 90% by mass, more preferably at least 95% by mass.

The aforementioned polyvinyl alcohol includes cation-modified polyvinyl alcohol, anion-modified polyvinyl alcohol, silanol-modified polyvinyl alcohol and other polyvinyl alcohol derivatives in addition to polyvinyl alcohol (PVA). The polyvinyl alcohols may be used alone, or two or more of them may used in combination.

The PVA has a hydroxyl group in its structural unit, and this hydroxy group and a silanol group on the surface of silica fine particles form a hydrogen bond, easily forming a three-dimensional network structure having secondary particles of silica fine particles as a chain unit. It is considered that this can form a colorant receiving layer of a porous structure having a high porosity by formation of the aforementioned three-dimensional network structure.

In ink-jet recording, the thus obtained porous colorant receiving layer rapidly absorbs an ink by capillary phenomenon, and can form a dot having no ink blur and having the better true circularity.

An amount of the water-soluble resin (polyvinyl alcohol) is preferably 9 to 40% by mass, further preferably 12 to 33% by mass relative to a total solid contents weight of a colorant receiving layer from a viewpoint that reduction in the film strength and cracking at drying due to too small content are prevented, and due to a too large content, a void is easily filled with a resin, and the ink absorbing property is reduced by decrease in a porosity, and this decrease is prevented.

A number average polymerization degree of the polyvinyl alcohol is preferably 1800 or larger, further preferably 2000 or larger from the viewpoint of prevention of cracking. In addition, from the viewpoint of transparency and a viscosity of a colorant receiving layer coating solution, PVA having a saponification degree of 88% or larger is further preferable, and PVA having a suponification degree of 95% or larger is particularly preferable.

Ratio of Gas Phase Method Silica and Polyvinyl Alcohol to be Contained

A ratio of gas phase method silica (when the silica is used with other inorganic fine particles in combination, a total mass of inorganic fine particles is represented by "I") and polyvinyl alcohol (when the polyvinyl alcohol is used with other water-soluble resin, a total mass of water-soluble resin is represented by "p") to be contained [PB ratio (i:p), mass of gas phase method silica relative to 1 part by mass of polyvinyl alcohol] greatly influences also on a film structure of a colorant receiving layer. That is, as a PB ratio grows larger, a porosity, a micropore volume and a specific surface area (per unit mass) grow larger.

Specifically, the PB ratio (i:p) is preferably 1.5:1 to 10:1 from a viewpoint that reduction in the film strength and cracking at drying due to too large PB ratio are prevented, and due to too small PB ratio, a void is easily filled with a resin, and a porosity is reduced, and reduction in the ink absorbing property is prevented.

Since a stress is applied to a recording sheet in some cases when passing through a conveying system for an ink-jet printer, it is necessary that a colorant receiving layer has the sufficient film strength. For preventing cracking, peeling and the like of a colorant receiving layer when cutting-processed into sheet-like, it is also necessary that a colorant receiving layer has the sufficient film strength.

In this case, the PB ratio is preferably 5:1 or smaller and, from the viewpoint of maintaining also the high speed ink absorbing property with an ink-jet printer, the ratio is preferably 2:1 or larger.

For example, when a coating solution in which anhydrous silica fine particles having an average primary particle diameter of 20 nm or smaller and a water-soluble resin are completely dispersed in an aqueous solution at a PB ratio of 2:1 to 5:1 is coated on a support, and the coated layer is dried, a three-dimensional network structure having secondary particles of silica fine particles as a chain unit is formed, and a transparent porous film having an average micropore diameter of 30 nm or smaller, a porosity of 50% to 80%, a micropore specific volume of 0.5 ml/g or larger and a specific surface area of 100 $m^2/g$ or larger can be easily formed.

Boron Compound

A colorant receiving layer for the ink-jet recording sheet of the invention contains a boron compound. By the boron compound, the water-soluble resin is cross-linked to harden a coated layer, thereby, a colorant receiving layer is formed.

The boron compound is contained in a first coating solution at a mass ratio of preferably 0.05 to 0.50, more preferably 0.08 to 0.30 relative to 1 of the water-soluble resin. When the boron compound is contained at the above range, a water-soluble resin can be sufficiently cross-linked, and cracking and the like can be prevented. In addition, the printing density and the glossiness of an image can be improved as compared with the case where a boron compound is added to a second coating solution.

The concentration of the boron compound in a first coating solution is preferably 0.05 to 10% by mass, more preferably 0.1 to 7% by mass.

Examples of the boron compound include borax, boric acid, boric acid salt (e.g. orthoboric acid salt, $InBO_3$, $ScBO_3$, $YBO_3$, $LaBO_3$, $Mg_3(BO_3)_2$, $Co_3(BO_3)_2$, diboric acid salt (e.g. $Mg_2B_2O_5$, $CO_2B_2O_5$), metaboric acid salt (e.g. $LiBO_2$, $Ca(BO_2)_2$, $NaBO_2$, $KBO_2$), tetraboric acid salt (e.g. $Na_2B_4O_7 \cdot 10H_2O$), pentaboric acid salt (e.g. $KB_5O_8 \cdot 4H_2O$, $Ca_2B_6O_{11} \cdot 7H_2O$, $CsB_5O_5$) and the like.

Inter alia, from the viewpoint of rapid cross-linking reaction with polyvinyl alcohol, borax, boric acid and boric acid salt are preferable, and boric acid is more preferable.

Alternatively, glyoxal, melamine formaldehyde (e.g. methylolmelamine, alkylated methylolmelamine), methylolurea, resol resin, polyisocyanate, epoxy resin and the like may be used in combination thereof.

Further, when the polyvinyl alcohol is used with gelatin in combination, the following compounds which are known as a film hardening agent for gelatin may be used in combination thereof.

Examples are aldehyde type compounds such as formaldehyde, glyoxal, glutaraldehyde; ketone type compounds such as diacetyl, cyclopentanedione; active halogen compounds such as bis(2-chloroethylurea)-2-hydroxy-4,6-dichloro-1,3,5-triazine, 2,4-dichloro-6-S-triazine sodium salt; active vinyl compounds such as divinylsulfonic acid, 1,3-vinylsulfonyl-2-propanol, N,N'-ethylenebis(vinylsulfonylacetamide), 1,3,5-triacryloylhexahydro-S-triazine; N-methylol compounds such as dimethylolurea, methyloldimethylhydantoin;

isocyanate type compounds such as 1,6-hexamethylene diisocyanate; aziridine type compounds described in U.S. Pat. Nos. 3,017,280 and 2,983,611; carboxyimide type compounds described in U.S. Pat. No. 3,000,704; epoxy type compounds such as glycerol triglycidyl ether; ethyleneimino type compounds such as 1,6-hexamethylene-N,N'-bisethyleneurea; halogenated carboxyaldehyde type compounds such as mucochloric acid, mucophenoxychloric acid; dioxane type compound such as 2,3-dihydroxydioxane; chromium alum, potassium alum, zirconium sulfate, chromium acetate and the like.

The aforementioned cross-linking agents may be used alone, or may be used by combining two or more of them.

Metal Compound

A metal compound to be added to a second coating solution can be used without any limitation as far as it is stable under the basic condition at pH of 8 or higher. The metal compound may be a metal salt or a metal complex compound, or an inorganic oligomer, or an inorganic polymer. As the metal compound, compounds exemplified as an inorganic mordant described later are preferably used. Inter alia, a zirconium compound and a zinc compound are preferable, in particular, a tri- or more- valent metal compound (e.g. zirconium compound) is preferable. Examples thereof include ammonium zirconium carbonate, ammonium zinc acetate, ammonium zinc carbonate, ammonium zirconium nitrate, potassium zirconium carbonate, ammonium zirconium citrate and the like.

Cationic Resin

It is preferable that the inorganic fine particles are used by dispersing with a cationic resin.

The cationic resin is not particularly limited however water-soluble or aqueous emulsion type can be suitably used. Examples of the cationic resin include dicyan type cationic resins, a representative of which is a dicyandiamide-formalin polycondensate, polyamine type cationic resins, a representative of which is a dicyanamide-diethylenetriamine polycondensate, epichlorohydrin-dimethylamine addition polymer, dimethyldiallylammonium chloride-$SO_2$ copolymer, diallylamine salt-$SO_2$ copolymer, dimethyldiallylammonium chloride polymer, allylamine salt polymer, dialkylaminoethyl (meth)acrylate quaternary salt polymer, polycationic cationic resins such as acrylamide-diallylamine salt copolymer. Dimethyldiallylammonium chloride, monomethyldiallylammonium chloride and polyamidine are preferable and, from the viewpoint of the water resistance, dimethyldiallylammonium chloride and monomethylammonium chloride are particularly preferable. The cationic resins may be used alone, or two or more of them may be used in combination thereof. In addition, as a cationic resin, a copolymer of dialkylaminoethyl (meth)acrylate quaternary salt and styrene is also preferably used.

An amount of the cationic resin to be added to a colorant receiving layer is regulated in the range of preferably 1 to 30 parts by mass, further preferably 3 to 20 parts by mass relative to 100 parts by mass of inorganic fine particles. The cationic resin may be added at a small amount before grinding and dispersion and, after ground and dispersed to desired particle diameter, may be further added.

Surfactant

It is preferable that the first coating solution contains a nonionic or amphoteric surfactant, and the second coating solution contains a nonionic surfactant.

Examples of the nonionic surfactant include polyoxyalkylene alkyl ether and polyoxyalkylene alkyl phenyl ethers (e.g. diethylene glycol monoethyl ether, diethylene glycol diethyl ether, polyoxyethylene lauryl ether, polyoxyethylene stearyl ether, polyoxyethylene nonyl phenyl ether etc.), oxyethylene oxypropylene block copolymer, sorbitan fatty acid esters (e.g. sorbitan monolaurate, sorbitan monooleate, sorbitan trioleate etc.), polyoxyethylene sorbitan fatty acid esters (e.g. polyoxyethylene sorbitan monolaurate, polyoxyethylene sorbitan monooleate, polyoxyethylene sorbitan trioleate etc.), polyoxyethylene sorbitol fatty acid esters (e.g. tetraoleic acid polyoxyethylene sorbit etc.), glycerin fatty acid esters (e.g. glycerol monooleate etc.), polyoxyethylene glycerin fatty acid esters (monostearic acid polyoxyethylene glycerin, monooleic acid polyoxyethylene glycerin etc.), polyoxyethylene fatty acid esters (polyethylene glycol monolaurate, polyethylene glycol monooleate etc.), polyoxyethylene alkylamine and the like. Polyoxyalkylene alkyl ethers are preferable. The nonionic surfactant can be used in the first coating solution and the second coating solution. The nonionic surfactants may be used alone, or two or more of them may be used in combination thereof. In addition, when the nonionic surfactants are used in both of the first coating solution and the second coating solution, they may be the same or different.

Examples of the amphoteric surfactant include amino acid type, carboxyammonium betaine type, sulfon ammonium betaine, ammonium sulfate ester betaine type, immidazolium betaine type and the like. For example, those described in U.S. Pat. No. 3,843,368, JP-A Nos. 59-49535, 63-236546, 5-303205, 8-262742, 10-282619 and the like can be suitably used. As the amphoteric surfactant, an amino acid type amphoteric surfactant is preferable. The amino acid type amphoteric surfactant is derivatized, from an amino acid (glycine, glutamic acid, histidic acid etc.) as described in JP-A No. 5-303205, and examples thereof include N-aminoacylic acid in which a long chain acyl group is introduced, and a salt thereof. The amphoteric surfactants may be used alone, or two or more of them may be used in combination thereof. Further, the amphoteric surfactant may be used with the aforementioned nonionic surfactant in combination.

An amount of a nonionic or amphoteric surfactant in a first coating solution is preferably 0.01 to 1% by mass, particularly preferably 0.03 to 0.6% by mass. In addition, an amount of a nonionic surfactant in a second coating solution is preferably 0.001 to 0.5% by mass, particularly preferably 0.05 to 0.3% by mass.

A High Boiling Point Organic Solvent

By inclusion of the nonionic or amphoteric surfactant and a high boiling point organic solvent in the first coating solution, a curl of an ink-jet recording sheet can be retained flat.

The high boiling point organic solvent is preferably water-soluble, and examples of the water-soluble high boiling point organic solvent include alcohols such as ethylene glycol, propylene glycol, diethylene glycol, triethylene glycol, glycerin, diethylene glycol monobutyl ether (DEGMBE), triethylene glycol monobutyl ether, glycerin monomethyl ether, 1,2,3-butanetriol, 1,2,4-butanetriol, 1,2,4-pentanetriol, 1,2,6-hexanetriol, thiodiglycol, triethanolamine, polyethylene glycol (weight average molecular weight is 400 or smaller), preferably, diethylene glycol monobutyl ether (DEGMBE).

An amount of the high boiling point organic solvent in a coating solution is preferably 0.05 to 1% by mass, particularly preferably 0.1 to 0.6% by mass.

Mordant

In the invention, in order to further improve the water resistance and the blur with time resistance of a formed image, it is preferable that a mordant (organic mordant, inorganic mordant) is contained in a colorant receiving layer.

By the presence of a mordant in a colorant receiving layer, the mordant interacts with a liquid ink having an anionic dye as a colorant to stabilize the colorant, and the water resistance and the blur with time resistance can be improved.

However, when this is added directly to a first coating solution for forming a colorant receiving layer, there is a possibility that aggregation occurs between gas phase method silica having an anionic charge. However, when a method of preparing and coating as an independent separate solution is utilized, it is not necessary to be anxious about aggregation of inorganic fine particles. Therefore, in the invention, it is preferable that a mordant is contained in a second coating solution (basic solution) unlike the aforementioned gas phase method silica.

In addition, it is preferable to use a basic mordant (e.g. polyallylamine) and, by using a basic mordant, it plays a role as a mordant and, at the same time, as a basic substance, and it becomes possible to prepare a basic solution without using a basic substance.

As an organic mordant, a cationic mordant is preferably used, and a polymer mordant having a primary to tertiary amino group, or a quaternary ammonium base group as a cationic group is suitably used, however a cationic non-polymer mordant can be also used.

As the polymer mordant, a homopolymer of a monomer (mordant monomer) having a primary to tertiary amino group or a salt thereof, or a quaternary ammonium base, or a copolymer or a polycondensate of the mordant monomer and other monomer (hereinafter, referred to as "non-mordant polymer") is preferable. In addition, these polymer mordants can be used in any form of a water-soluble polymer, or water-dispersible latex particles.

Examples of the aforementioned monomer (mordant monomer) include trimethyl-p-vinylbenzylammonium chloride, trimethyl-m-vinylbenzylammonium chloride, triethyl-p-vinylbenzylammonium chloride, triethyl-m-vinylbenzylammonium chloride, N,N-diemthyl-N-ethyl-N-p-vinylbenzlammonium chloride, N,N-diethyl-N-methyl-N-p-vinylbenzylammonium chloride, N,N-dimethyl-N-n-propyl-N-p-vinylvenzylammonium chloride, N,N-dimethyl-N-n-octyl-N-p-vinylbenzylammonium chloride, N,N-dimethyl-N-benzyl-N-p-vinylbenzylammonium chloride, N,N-diethyl-N-benzyl-N-p-vinylbenzylammonium chloride, N,N-dimethyl-N-(4-methyl)benzl-N-p-vinylbenzylammonium chloride, N,N-dimethyl-N-phenyl-N-p-vinylbenzylammonium-chloride, trimethyl-p-vinylbenzylammonium bromide, trimethyl-m-vinylbenzylammonium bromide, trimethyl-p-vinylbenzylammonium sulfonate, trimethyl-m-vinylbenzyl ammonium sulfonate, trimethyl-p-vinylbenzylammonium acetate, trimethyl-m-vinylbenzylammonium acetate, N,N,N-triethyl-N-2-(4-vinylphenyl)ethylammonium chloride, N,N,N-triethyl-N-2-(3-vinylphenyl)ethylammonium chloride, N,N-diethyl-N-methyl-N-2-(4-vinylphenyl)ethylammonium chloride, N,N-diethyl-N-methyl-N-2-(4-vinylphenyl)ethylammonium acetate, quaterized compounds from methyl chloride, ethyl chloride, methyl bromide, ethyl bromide, methyl iodide or ethyl iodide of N,N-dimethylaminoethyl(meth)acrylate, N,N-diethylaminoethyl(meth)acrylate, N,N-dimethylaminopropyl(meth)acrylate, N,N-diethylaminopropyl(meth)acrylate, N,N-dimethylaminoethyl(meth)acrylamide, N,N-diethylaminoethyl (meth)acrylamide, N,N-dimethylaminopropyl(meth) acrylamide, N,N-dimethylaminopropyl(meth)acrylaamide, or sulfonic acid salts, alkylsulfonic acid salts, acetic acid salts or alkylcarboxylic acid salts in which their anion is substituted.

Specifically, examples thereof include monomethyldiallylammonium chloride, trimethyl-2-(methacryloyloxy)ethylammonium chloride, triethyl-2-(methacryloyloxy)ethylammonium chloride, trimethyl-2-(acryloyloxy) ethylammonium chloride, triethyl-2-(acryloyloxy) ethylammonium chloride, trimethyl-3-(methacryloyloxy) propylammonium chloride, triethyl-3-(methacryloyloxy) propylammonium chloride, trimethyl-2-(methacryloylamino)ethylammonium chloride, triethyl-2-(methacryloylamino)ethylammonium chloride, trimethyl-2-(acryloylamino)ethylammonium chloride, triethyl-2-(acryloylamino)ethylammonium chloride, trimethyl-3-(methacryloylamino)propylammonium chloride, triethyl-3-(methacryloylamino)propylammonium chloride, trimethyl-3-(acryloylamino)propylammonium chloride, triethyl-3-(acryloylamino)propylammonium chloride, N,N-dimethyl-N-ethyl-2-(methacryloyloxy)ethylammonium chloride, N,N-diethyl-N-methyl-2-(methacryloyloxy)ethylammonium chloride, N,N-dimethyl-N-ethyl-3-(acryloylamino) propylammonium chloride, trimethyl-2-(methacryloyloxy) ethylammonium bromide, trimethyl-3-(acryloylamino) propylammonium bromide, trimethyl-2-(methacryloyloxy) ethylammonium sulfonate, trimethyl-3-(acryloylamino) propylammonium acetate and the like.

Besides, examples of a copolymerizable monomer include N-vinylimidazole, N-vinyl-2-methylimidazole and the like.

The aforementioned non-mordant polymer refers to a monomer which does not contain a basic or cationic part such as a primary to tertiary amino group or a salt thereof, or a quaternary ammonium base, and does not interact with a dye in an ink-jet ink, or substantially hardly interacts with the dye.

Examples of the non-mordant monomer include alkyl (meth)acrylate ester; cycloalkyl (meth)acrylate ester such as cyclohexyl (meth)acrylate; aryl (meth)acrylate ester such as phenyl (meth)acrylate; aralkyl ester such as benzyl (meth) acrylate; aromatic vinyls such as styrene, vinyltolene, α-methylstyrene; vinyl esters such as vinil acetate, vinyl propionate, vinyl versatate; allyl esters such as allyl acetate; halogen-containing monomers such as vinylidene chloride, vinyl chloride; vinyl cyanate such as (meth)acrylonitrile; olefins such as ethylene, propylene, and the like.

As the alkyl (meth)acrylate ester, alkyl (meth)acrylate ester having an alkyl part of a carbon number of 1 to 18 is preferable, and examples thereof include methyl (meth) acrylate, ethyl (meth)acrylate, propyl (meth)acrylate, isopropyl (meth)acrylate, n-butyl (meth)acryalte, isobutyl (meth)acrylate, t-butyl (meth)acrylate, hexyl (meth)acrylate, octyl (meth)acrylate, 2-ethylhexyl (meth)acrylate, lauryl (meth)acrylate, stearyl (meth)acrylate and the like.

Inter alia, methyl acrylate, ethyl acrylate, methyl methacrylate, ethyl methacrylate, and hydroxyethyl methacrylate are preferable.

The non-mordant monomers may be also used alone, or may be used by combining two or more of them.

Further, preferable examples of the polymer mordant include polydiallyldimethylammonium chloride, polymethacryloyloxyethyl-β-hydroxyethyldimethylammonium chloride, polyethyleneimine, polyallylamine and its modification, polyallylamine hydrochloride, polyamide-polyamine resin, cationated starch, dicyandiamidoformalin condensate, dimethyl-2-hydroxypropylammonium salt polymer, polyamidine, polyvinylamine, and cationic polyurethane resin described in JP-A No. 10-86505. Polyallylamine and modified polyallylamine are particularly preferable.

The modified polyallylamine is polyallylamine to which 2 to 50% by mole of acrylonitrile, chloromethylstyrene, TEMPO, epoxyhexyane, sorbic acid or the like is added. Preferable is polyallylamine to which 5 to 10% by mole of acrylonitrile, chloromethylstyrene or TEMPO is added. From the viewpoint of exertion of the ozone fading property preventing effect, polyallylamine to which 5 to 10% by mole of TEMPO is added is particularly preferable.

A molecular weight of the mordant is preferably 2,000 to 300,000 expressed as a weight average molecular weight. When the molecular weight is in the range of 2,000 to 300,000, the water resistance and the blur with time resistance can be improved.

As the mordant in the invention, an inorganic mordant may be used, and examples of the inorganic mordant include a polyvalent water-soluble metal salt or hydrophobic metal salt compound.

Examples of the inorganic mordant include a salt or a complex of a metal selected from magnesium, aluminium, calcium, scandium, titanium, vanadium, manganese, iron, nickel, copper, zinc, gallium, germanium, strontium, yttrium, zirconium, molybdenum, indium, barium, lanthanum, cerium, praseodymium, neodymium, samarium, europium, gadolinium, dysprosium, erbium, ytterbium, hafnium, tungsten and bismuth.

Specifically, examples thereof include calcium acetate, calcium chloride, calcium formate, calcium sulfate, barium acetate, barium sulfate, barium phosphate, manganese chloride, manganese acetate, manganese formate dihydrate, ammonium manganese sulfate hexahydrate, cupric chloride, ammonium copper (II) chloride dihydrate, copper sulfate, cobalt chloride, cobalt thiocyanate, cobalt sulfate, nickel sulfate hexahydrate, nickel chloride hexahydrate, nickel acetate tetrahydrate, ammonium nickel sulfate hexahydrate, nickel amidosulfate tetrahydrate, aluminium sulfate, aluminium alum, basic polyaluminium hydroxide, aluminium sulfite, aluminium thiosulfate, polyaluminium chloride, aluminium nitrate nanohydrate, aluminium chloride hexahydrate, ferrous bromide, ferrous chloride, ferric chloride, ferrous sulfate, ferric sulfate, zinc phenolsulfonate, zinc bromide, zinc chloride, zinc nitrate hexahydrate, zinc sulfate, ammonium zinc acetate, ammonium zinc carbonate, titanium tetrachloride, tetraisopropyl titanate, titanium acetylacetonate, titanate lactate, zirconium acetylacetonate, zirconyl acetate, ziconyl sulfate, ammonium zirconium carbonate, ammonium zirconium nitrate, potassium zirconium carbonate, ammonium zirconium citrate, zirconyl stearate, zirconyl octate, zirconyl nitrate, zirconium oxychloride, zirconium hydroxychloride, chromium acetate, chromium sulfate, magnesium sulfate, magnesium chloride hexahydrate, magnesium citrate nanohydrate, sodium phosphotungstate, sodium tungsten citrate, 12 tungstophosphoric acid n-hydrate, 12 tungstosilisic acid 26-hydrate, molybdenum chloride, 12 molybdophosphoric acid n-hydrate, gallium nitrate, germanium nitrate, strontium nitrate, yttrium acetate, yttrium chloride, yttrium nitrate, indium nitrate, lanthanum nitrate, lanthanum chloride, lanthanum acetate, lanthanum benzoate, cerium chloride, cerium sulfate, cerium octate, praseodymium nitrate, neodymium nitrate, samarium nitrate, europium nitrate, gadolinium nitrate, dysprosiumnitrate, erbiumnitrate, ytterbiumnitrate, hafnium chloride, bismuth nitrate and the like.

As the inorganic mordant in the invention, an aluminium-containing compound, a titanium-containing compound, a zirconium-containing compound, and a metal compound (salt or complex) of Element Periodic Law Table IIIB Group type are preferable.

An amount of the mordant contained in a colorant receiving layer in the invention is preferably 0.01 $g/m^2$ to 5 $g/m^2$, more preferably 0.1 $g/m^2$ to 3 $g/m^2$.

In view of the stability of a solution, the mordant is added to a first coating solution or a second coating solution. For example, since there is a possibility that aggregation may occur between gas phase method silica having an anionic charge when an organic cationic mordant is added to a first coating solution containing gas phase method silica, it is better to add it to a second coating solution.

In addition, among inorganic mordants, an inorganic mordant which is stable under the acidic condition (e.g. polyaluminium chloride) is preferably added to a first coating solution, and an inorganic mordant which is stable under the alkaline condition (e.g. ammonium zinc acetate, ammonium zinc carbonate, ammonium zirconium carbonate, ammonium zirconium nitrate, potassium zirconium carbonate, ammonium zirconium citrate) is desirably added to a second coating solution.

Two or more kinds of mordants, whether organic or inorganic, may be used, or an organic mordant and an inorganic mordant may be used in combination thereof.

In addition, a basic mordant (e.g. polyallylamine) plays a roll as a mordant, at the same time, as the basic substance, and it becomes possible to prepare a basic solution without a basic substance.

Ozone Fading Preventing Agent

In addition, in the ink-jet recording sheet of the invention, ozone fading can be prevented by inclusion of an ozone fading preventing agent such as thiourea, thiocyanate in a colorant receiving layer.

Example of the thiocyanate include ammonium thiocyanate, zinc thiocyanate, calcium thiocyanate, potassium thiocyanate, sodium thiocyanate, magnesium thiocyanate, aluminium thiocyanate, lithium thiocyanate, silver thiocyanate, chloromethyl thiocyanate, cobalt thiocyanate, copper thiocyanate, lead thiocyanate, barium thiocyanate, benzyl thiocyanate and the like. The thiourea and thiocyanate may be used alone, or two or more of them may be used in combination thereof.

In the invention, although the thiourea or the thiocyanate may be added to any of the first coating solution and the second coating solution, it is preferable to add it to a second coating solution to impart it to a colorant receiving layer from the viewpoint of the solution stability. An amount of the thiourea or the thiocyanate is preferably 1 to 20% by mass, particularly preferably 2 to 10% by mass. When the content is 1% by mass or larger, the ozone fading preventing effect can be more sufficiently exerted and, when the content is less than 20% by mass, occurrence of cracking can be sufficiently suppressed.

Other Components

A colorant receiving layer may contain fading preventing agents such as the following components, if needed.

For suppressing deterioration of a colorant, the colorant receiving layer may contain various ultraviolet absorbing agents, antioxidant, singlet oxygen quenchers and the like.

Examples of the ultraviolet absorbing agents include cinnamic acid derivatives, benzophenone derivatives, benzotriazolylphenol derivatives and the like. Embodiments thereof include butyl α-cyano-phenylcinnamate, o-benzotriazolephenol, o-benzotriazole-p-chlorophenol, o-benzotriazole-2,4-di-t-butylphenol, o-benzotriazole-2,4-di-t-octylphenol and the like. A hindered phenol compound may be also used as an ultraviolet absorbing agent and, specifically, a phenol derivative in which at least one of 2-position and 6-position is substituted with a branched alkyl group is preferable.

Alternatively, benzotriazole type ultraviolet absorbing agents, salicylic acid type ultraviolet absorbing agents, cyanoacrylate type ultraviolet absorbing agents, oxalic acid anilide ultraviolet absorbing agents and the like may be used. Those ultraviolet absorbing agents are described, for example, in JP-A Nos. 47-10537, 58-111942, 58-212844, 59-19945, 59-46646, 59-109055, 63-53544, Japanese Patent Application Publication (JP-B) Nos. 36-10466, 42-26187, 48-30492, 48-32255, 48-41572, 48-54965, 50-10726, U.S. Pat. Nos. 2,719,086, 3,707,375, 3,754,919, 4,220,711 and the like.

A fluorescent brightening agent may be used as an ultraviolet absorbing agent, and examples thereof include a coumarin type fluorescent brightening agent and the like. Specifically, those agents are described in JP-B Nos. 45-4699, 54-5324 and the like.

Examples of the antioxidant include antioxidant described in EP Laid-Open No. 223739, 309401, 309402, 310551, 310552, 459416, German Patent Laid-Open No. 3435443, JP-A Nos. 54-48535, 60-107384, 60-137383, 60-125470, 60-125471, 60-125472, 60-287485, 60-287486, 60-287487, 60-287488, 61-160287, 61-185483, 61-211079, 62-146678, 62-146680, 62-146679, 62-282885, 62-262047, 63-051174, 63-89877, 63-88380, 66-88381, 63-113536, 63-163351, 63-203372, 63-224989, 63-251282, 63-267594, 63-182484, 1-239282, 2-262654, 2-71262, 3-121449, 4-291685, 4-291684, 5-61166, 5-119449, 5-188687, 5-188686, 5-110490, 5-1108437, 5-170361, JP-B Nos. 48-43295, 48-33212, U.S. Pat. Nos. 4,814,262, 4,980,275 and the like.

Specifically, examples thereof include 6-ethoxy-1-phenyl-2,2,4-trimethyl-1,2-dihydroquinoline, 6-ethoxy-1-octyl-2,2,4-trimethyl-1,2-dihydroquinoline, 6-ethoxy-1-phenyl-2,2,4-trimethyl-1,2,3,4-tetrahydroquninoline, 6-ethoxy-1-octyl-2,2,4-trimethyl-1,2,3,4-tetrahydroquinoline, nickel cyclohexanoate, 2,2-bis(4-hydroxyphenyl)propane, 1,1-bis(4-hydroxyphenyl)-2-ethylhexane, 2-methyl-4-methoxydiphenylamine, 1-methyl-2-phenylindole and the like.

The fading preventing agents may be used alone, or two or more of them may be used in combination thereof. This fading preventing agent may be rendered water-soluble, dispersed or emulsified or may be contained in a microcapsule.

An amount of the fading preventing agent is preferably 0.01 to 10% by mass of a first coating solution.

In addition, for the purpose of enhancing the dispersibility of inorganic fine particles, a colorant receiving layer may contain various inorganic salts, or acids or alkalis as pH adjusting agent.

Further, for suppressing friction electrification or peeling electrification of the surface, a colorant receiving layer may contain metal oxide fine particles having the electron conductivity and, for reducing friction property of the surface, the colorant receiving layer may contain various matting agents.

Method of Forming Colorant Receiving Layer

Then, a method of forming a colorant receiving layer will be explained.

A colorant receiving layer in the ink-jet recording sheet of the invention is a layer obtained by cross-linking and hardening a coated layer obtained by coating a first coating solution including inorganic fine particles, a water-soluble resin and a boron compound. The cross-linking and hardening is performed by applying a solution of pH of 8 or higher containing a metal compound (second coating solution) to the coated layer or the coated film at any time of (1) at the same time as coating the coating solution, (2) during drying of the coating layer formed by coating the coating solution and before the coated layer shows a falling rate of drying, or (3) after the coated layer formed by coating the coated solution is dried to form the coated film.

A coating solution containing gas phase method silica, a cationic resin, boric acid, PVA, a nionic or amphoteric surfactant and a high boiling point organic solvent (colorant receiving coating solution) can be prepared, for example, as follows:

That is, gas phase method silica is added to water, a cationic resin is further added, dispersed with a high pressure homogenizer, a sand mill or the like, boric acid is added, an aqueous polyvinyl alcohol solution (e.g. so that a mass of PVA is around 1–3 a mass of gas phase method silica) is added, a nonionic or amphoteric surfactant and a high boiling point organic solvent are added, and the mixture is stirred, thereby, a colorant receiving layer can be prepared. The resulting coating solution is a uniform sol, and this is coated on a support by the following coating method, whereby, a porous colorant receiving layer having a three-dimensional network structure can be formed.

As descried above, by adding polyvinyl alcohol after dilution of boric acid, partial gelatinization of polyvinyl alcohol can be prevented.

In the invention, it is preferable that a first coating solution is an acid solution, and pH of the coating solution is preferably 5.0 or lower, more preferably 4.5 or lower, further preferably 4.0 or lower. pH of the coating solution can be adjusted by appropriately selecting a kind and an addition amount of the cationic resin. Alternatively, pH may be adjusted by adding an organic or inorganic acid. When pH of the coating solution is 5.0 or lower, a cross-linking reaction of an aqueous resin due to a boron compound in a coating solution can be more sufficiently suppressed.

Coating of a first coating solution can be performed by the known coating method such as extrusion die coater, air doctor coater, bread coater, rod coater, knife coater, squeeze coater, reverse roll coater, bar coater.

An amount of a first coating solution to be coated is generally 50 to 300 g/m$^2$, preferably 100 to 250 g/m$^2$.

It is required that pH of a second coating solution is 8.0 or higher, preferably 9.0 or higher, more preferably 9.2 or higher, further preferably 9.5 or higher. When pH of a basic solution is lower than 8.0, cracking of a colorant receiving layer occurs. This pH adjustment may be performed with a basic metal compound or a basic mordant (e.g. ammonium zirconium carbonate etc.), or with other basic substance (sodium hydroxide, potassium hydroxide, calcium hydroxide, ammonia, tetramethylammoniumhydroxide, ethanolamine, ethylenediamine, or a salt thereof etc.), or both of them may be used. Colloidal silica exhibiting the alkaline property, for example, "SNOWTEX® 20, 30, 40, C, N, S, 20L, XS, SS, XL, YL, ZL, UP, QAS-40, LSS-35" manufactured by Nissan Chemical Industries, Ltd. may be used to adjust pH.

Alternatively, a cross-linking agent used in a first coating solution may be added to a second coating solution under the condition of pH of 8 or higher.

It is preferable that a second coating solution is applied before a coated layer after coating shows a falling rate of drying rate.

Here, "before a coated layer shows a falling rate of drying" generally refers to from immediately after coating of a coating solution to a few minutes and, during this term, a constant rate drying rate, phenomenon in which an amount of a solvent in a coated layer is decreased in proportion to a time, is shown. Time showing the constant rate drying rate is described in Chemical Technology Handbook (pp. 707–712, published by Maruzen Co., Ltd., Oct. 25, 1980).

As described above, after coating of a first coating solution, the coated layer is dried until a falling rate of drying is exhibited, and the drying is generally performed at 40 to 180° C. for 0.5 to 10 minutes (preferably, 0.5 to 5 minutes). This drying time is of course different depending on a coating amount, and the aforementioned range is suitable.

As a method of applying a second coating solution before the coated layer exhibits a falling rate of drying, there are (1) a method of further coating the second coating solution on a coated layer, (2) a method of spraying by a spraying method, (3) a method of immersing a support, on which the coated layer is formed, into the second coating solution, and the like.

In the method (1), as a method of coating the second coating solution, the known coating method such as curtain flow coater, extrusion die coater, air doctor coater, bread coater, rod coater, knife coater, squeeze coater, reverse roll coater, bar coater can be utilized. However, it is preferable that a method in which a coater is not directly contacted with the already formed coated layer is utilized, as in extrusion die coater, curtain flow coater, a bar coater and the like.

A coating amount of the second coating solution is generally 5 to 50 g/m$^2$, preferably 10 to 30 g/m$^2$.

Alternatively, the second coating solution may be applied at the same time with coating the first coating solution.

In this case, the first coating solution and the second coating solution are coated at the same time (overlaying coating) on a support so that the first coating solution is contacted with the support and, thereafter, they are dried to harden, thereby, a colorant receiving layer can be formed.

The aforementioned simultaneous coating (overlaying coating) can be performed, for example, by a coating method using the extrusion die coater, the carton flow or coater. After simultaneous coating, the formed coated layer is dried and, in this case, drying is generally performed by heating a coated layer at 40 to 150° C. for 0.5 to 10 minutes, preferably at 40 to 100° C. for 0.5 to 5 minutes.

For example, when a boron compound is used, it is preferable to heat at 60 to 100° C. for 5 to 20 minutes.

When the aforementioned simultaneous coating (overlaying coating) is performed, for example, by the extrusion die coater, simultaneously discharged two kinds coating solutions are overlaying-formed at a vicinity of a discharging port of the extrusion die coater, that is, before transference onto a support and, in that state, overlaying-coated on the support in that state. Since two-layered coating solutions which have been overlaid before coating easily cause a cross-linking reaction at an interface of two solutions upon transference onto a support, discharged two solutions are mixed and a viscosity is easily increased, causing disorder in coating procedures in some cases. Therefore, when upon simultaneous coating as described above, it is preferable that simultaneous triple layer coating is performed by intervening a barrier layer solution (intermediate layer solution) composed of a material which does not react with a cross-linking agent, together with coating of a first coating solution and a basic solution.

The barrier layer solution can be selected without any limitation as far as it does not react with boron compound and can form a liquid film. For example, embodiments include an aqueous solution containing a minor amount of a water-soluble resin which does not react with a boron compound, water and the like. The water-soluble resin is used in view of the coating property for the purpose of increasing a viscosity, and examples thereof include polymers such as hydroxypropylmethylcelluslose, methylcellulose, hydroxyethylmethylcellulose, polyvinylpyrrolidone, gelatin.

The barrier layer solution may contain the aforementioned mordant.

In addition, as a solvent in each step, water, an organic solvent, or a mixed solvent of them may be used. Examples of the organic solvent which can be used in this coating include alcohols such as methanol, ethanol, n-propanol, i-propanol, methoxypropanol, ketones such as acetone, methyl ethyl ketone, tetrahydrofuran, acetonitrile, ethyl acetate, toluene and the like.

After a colorant receiving layer is formed on a support, surface smoothness, glossiness, transparency and coated film strength of the colorant receiving layer can be improved by subjecting to the calendar treatment by passing between roll nips under heating and pressure using a supercalendar, a gloss calendar or the like. However, since the calendar treatment causes reduction in a porosity in some cases (that is, the ink absorbing property is reduced in some cases), it is necessary to set such the conditions that a porosity is hardly reduced.

A roll temperature in the case of calendar treatment is preferably 30 to 150° C., more preferably 40 to 100° C.

In addition, a line pressure between rolls at calendar treatment is preferably 50 to 400 kg/cm, more preferably 100 to 200 kg/cm.

It is necessary that a thickness of the colorant receiving layer is determined in connection with a porosity in a layer because such an absorption volume is necessary that all liquid droplets are absorbed in the case of ink-jet recording. For example, when an ink amount is 8 nL/mm$^2$ and a porosity is 60%, a film having a thickness of about 15 $\mu$m or larger is necessary.

In view of this point, in the case of ink-jet recording, a thickness of a colorant receiving layer is preferably 10 to 50 $\mu$m.

In addition, a micropore diameter of a colorant receiving layer is preferably 0.005 to 0.030 μm, more preferably 0.01 to 0.025 μm expressed as a median diameter.

The porosity and micropore median diameter can be measured using a mercury porosimeter (trade name: Poresizer 9320-PC2, manufactured by Simadzu Corporation).

In addition, it is preferable that a colorant receiving layer is excellent in transparency and, as its index, a haze value when a colorant receiving layer is formed on a transparent film support is preferably 30% or smaller, more preferably 20% or smaller.

The haze value can be measured using a hazemeter (trade name: HGM-2DP, manufactured by Suga Test Instrument Co., Ltd.).

Support

As the support, any of a transparent support composed of a transparent material such as a plastic, and an opaque support composed of an opaque material such as a paper can be used. From the viewpoint of utilization of transparency of a colorant receiving layer, it is preferable that a transparent support or an opaque support having high glossiness is used.

As a material which can be used in the transparent support, materials which are transparent and have the nature of enduring the radiated heat upon use in OHP and back light display are preferable. Examples of the materials include polyesters such as polyethylene terephthalate (PET); polysulfone, polyphenylene oxide, polyimide, polycarbonate, polyamide and the like. Inter alia, polyesters are preferable, and polyethylene terephthalate is particularly preferable.

A thickness of the transparent support is not particularly limited, however 50 to 200 μm is preferable from the viewpoint of the handing property.

As an opaque support having high glossiness, supports with the surface, on a side on which a colorant receiving layer is provided, having glossiness of 40% or larger are preferable. The glossiness is a value obtained according to the known method of testing a 75 degree specular surface glossiness of a paper and a board paper. Embodiments are the following supports.

Embodiments include paper supports having high glossiness such as RC paper, baryta paper which are used in art paper, coated paper, cast coated paper, silver salt photographic supports and the like; films having high glossiness by making opaque plastic films such as polyesters such as polyethylene terephthalate (PET), cellulose esters such as nitrocellulose, cellulose acetate, cellulose acetate butyrate, polysulfone, polyphenylene oxide, polyimide, polycarbonate, polyamide and the like (which may have the surface subjected to calendar treatment) by containing of a white pigment or the like; or supports in which a covering layer of polyolefin containing or not containing a white pigment is provided on the surface of the aforementioned various paper supports, the aforementioned transparent support and films containing a white pigment or the like and having high glossiness.

Example of a suitable embodiment includes a white pigment-containing expanded polyester film (e.g. expanded PET which contains polyolefin fine particles and in which a void is formed by stretching).

A thickness of the opaque support is not particularly limited, however 50 to 300 μm is preferable from the viewpoint of the handling property.

Alternatively, as the support, supports which have been subjected to corona discharge treatment, glow discharge treatment, flame treatment, ultraviolet-ray illumination treatment or the like may be used.

Then, a base paper used in the paper support will be described in detail.

The base paper is made using a timber pulp as a main raw material, if needed, using a synthetic pulp such as polypropylene, or a synthetic fiber such as nylon and polyester in addition to the timber pulp. As the timber pulp, any of LBKP, LBSP, NBKP, NBSP, LDP, NDP, LUKP and NUKP may be used, however it is preferable to use LBKP, NBSP, LBSP, NDP or LDP having many short fibers at a larger amount.

In this respect, a ratio of LBSP and/or LDP is preferably 10% by mass or larger and 70% by mass or smaller.

As the aforementioned pulp, a chemical pulp (sulfate pulp or sulfite pulp) having little impurities is preferably used, and a pulp, whiteness of which has been improved by breaching treatment, is also useful.

To a base paper, may be appropriately added a sizing agent such as higher fatty acid, alkyl ketene dimer, a white pigment such as calcium carbonate, talc, titanium oxide, a paper strength potentiator such as starch, polyacrylamide, polyvinyl alcohol, a fluorescent brightening agent, a moisture retaining agent such as polyethylene glycol, a dispersing agent, and a softening agent such as quaternary ammonium.

A degree of water filtration for a pulp used in paper making is preferably 200 to 500 ml according to CSF speculation, and it is preferable that a fiber length after beating is such that a sum of % by mass of 24 mesh remaining and % by mass of 42 mesh passing expressed by a value measured by known sieving test is 30 to 70%. In addition, it is preferable that % by mass of 4 mesh reminder is 20% by mass or smaller.

A basis weight of a base paper is preferably 30 to 250 g, particularly preferably 50 to 200 g. A thickness of a base paper is preferably 40 to 250 μm. The high smoothness may be applied to a base paper by calendar treatment at a paper making stage or after paper making. A base paper density is generally 0.7 to 1.2 g/m$^{2}$.

Further, a base paper stiffness is preferably 20 to 200 g.

A surface sizing agent may be coated on the surface of a base paper and, as the surface sizing agent, the same sizing agent as those that can be added to a base paper can be used.

It is preferable that pH of a base paper is 5 to 9 when measured by a hot water extracting method.

Polyethylene which covers the surface and the back of a base paper is mainly low density polyethylene (LDPE) and/or high density polyethylene (HDPE), however other LLDPE or polypropylene and the like may be partially used.

In addition, it is preferable that a degree of the opaqueness and whiteness of a polyethylene layer on a side on which a colorant receiving layer is formed are improved by adding rutile or anatase type titanium oxide to polyethylene as is widely performed in a photographic imaging paper. Here, an amount of titanium oxide is preferably around 3 to 20% by mass, more preferably 4 to 13% by mass relative to polyethylene.

A polyethylene covering paper may be used as a glossy paper, or a paper on which a matting surface or a silk texture surface as obtained in a normal photographic imaging paper is formed by performing so-called embossing treatment upon coating by melt-extruding polyethylene on the surface of a base paper, may be used.

EXAMPLES

The present invention will be explained by way of Examples below, however the invention is not limited by these Examples. "%" in Examples means "% by mass" unless otherwise indicated.

Example 1

Preparation of Support

An art paper (trade name: OK Kondo, manufactured by Oji Paper Co., Ltd.) having a basis weight of 186 g/m$^2$was subjected to corona discharge treatment, and high density polyethylene was coated thereon at a thickness of 19 $\mu$m using a melt-extruder to form a resin layer composed of a mat surface (hereinafter, a resin layer surface is referred to as "back"). The resin layer on this back side was further subjected to corona discharge treatment and, thereafter, a dispersion in which alluminium oxide (trade name: Alumina Sol 100, manufactured by Nissan Chemical Industries, Ltd.) and silicon dioxide (trade name: SNOWTEX® O, manufactured by Nissan Chemical Industries, Ltd.) were dispersed in water at a ratio (ratio by mass) of 1:2, as an antistatic agent, was coated at a dry mass of 0.2 g/m$^2$.

Further, a felt side (surface) on a surface on which no resin layer was provided was subjected to corona discharge treatment, low density polyethylene having MFR (melt flow rate) of 3.8 and containing 10% of anatase type titanium dioxide, a minor amount of ultramarine and 0.01% of a fluorescent brightening agent (relative to polyethylene) was melt-extruded at a thickness of 24 $\mu$m using a melt-extruder, to form a thermoplastic resin layer having high glossiness on a surface side of a base paper (hereinafter, this high glossy side is referred to as "front side"), whereby, a support was obtained. The front side of support was used by subjecting to corona discharge treatment before coating of a coating solution.

Preparation of First Coating Solution

The following composition: gas phase method silica fine particles, ion-exchanged water and a cationic resin (trade name: Sharol DC-902P, manufactured by Dai-ichi Kogyo Seiyaku Co., Ltd.) was dispersed at a rotation number of 2000 rpm for 120 minutes using a dissolver, and was further dispersed using a Daino mill disperser (filling amount of 0.65 mm zirconia beads 70%, circumferential rate 8 m/sec) to obtain a silica dispersion.

| Composition of silica dispersion | |
|---|---|
| Gas phase method silica fine particles (inorganic fine particles, an average primary particle diameter: 7 nm, trade name: Rheoseal QS-30, manufactured by Tokuyama Corp.) | 100 kg |
| Ion-exchanged water | 605.5 kg |
| Cationic resin (51.5% aqueous solution, trade name: Sharol DC-902P, manufactured by Dai-Ichi Kogyo Seiyaku Co., Ltd.) | 9.7 kg |

This silica dispersion had a viscosity of 46 mPa·s, pH of 2.90 and particle diameter of 0.139 $\mu$m.

715.2 kg of the aforementioned silica dispersion and 77.4 kg of an aqueous boric acid solution (5.30%) were mixed and stirred at a rotation number of 2000 rpm for 10 minutes with a dissolver. 317.2 kg of a 7% aqueous polyvinyl alcohol solution (trade name: PVA124, manufactured by Kuraray Co., Ltd.), 3.6 kg of diethylene glycol monobutyl ether, 9.3 kg of a 10% aqueous nonionic surfactant solution (trade name: Emulgen 109P, manufactured by Kao Corporation), and 0.6 kg of a fluorine surfactant (trade name: Megafac F-1405, manufactured by Dainippon Ink and Chemicals, Incorporated) were added thereto, and mixture was stirred at 750 rpm for 10 minutes to prepare a first coating solution for a colorant receiving layer. The coating solution had a viscosity of 59 mPa·s, pH of 3.40, particle diameter of 0.141 $\mu$m and a surface tension of 26.8 dyn/cm.

Preparation of Second Coating Solution

Respective components of the following composition were mixed to prepare a second coating solution. pH of the coating solution was 8.5.

| Composition of second coating solution | |
|---|---|
| Ion-exchanged water | 741.5 kg |
| Boric acid | 6.5 kg |
| Ammonium zirconium carbonate (trade name: Zircosol AC-7, manufactured by DAIICHI KIGENSO KAGAKU KOGYO CO., LTD.) | 150 kg |
| 2% aqueous nonionic surfactant solution (trade name: Emulgen 109P, manufactured by Kao Corporation) | 100 kg |
| Fluorine type surfactant (trade name: Megafac F-1405, manufactured by Dai-ichi Ink and Chemicals Incorporated) | 2.0 kg |

Preparation of Ink Jet Recording Sheet

The first coating solution was coated at a coating amount of 170 ml/m$^2$ on a front side of a support using an extrusion die coater (coating step), and dried at 80° C. (wind rate: 3 to 8 m/sec) until the solid contents concentration became 20%. The coated layer showed a constant rate drying rate during this term. Immediately after, this was immersed in a second coating solution for 30 seconds so that the second coating solution was attached on the coated layer at 20 g/m$^2$, and dried at 80° C. for 10 minutes (drying step). Thereby, an ink-jet recording sheet (1) of the invention on which a colorant receiving layer having a dry film thickness of 35 $\mu$m was provided, was prepared.

Example 2

According to the same manner as that of Example 1 except that a composition of the second coating solution in Example 1 was changed as described below, an ink-jet recording sheet (2) of the invention was prepared.

| Composition of second coating solution | |
|---|---|
| Ion-exchanged water | 741.5 kg |
| Boric acid | 6.5 kg |
| Ammonium zirconium carbonate (trade name; Zircosol AC7, manufactured by DAIICHI KIGENSO KAGAKU KOGYO CO., LTD.) | 75 kg |
| Colloidal silica (trade name: ST-N, manufactured by Nissan Chemical Industries, Ltd.) | 75 kg |
| 2% aqueous nonionic surfactant solution (trade name: Emulgen 109P, manufactured by Kao Corporation) | 100 kg |
| Fluorine surfactant (trade name: Megafac F-1405, manufactured by Dainippon Ink and Chemicals Incorporated) | 2.0 kg |

pH of the second coating solution was 9.1.

Example 3

According to the same manner as that of Example 1 except that preparation of the first coating solution was changed as described below, an ink-jet recording sheet (3) was prepared.

Preparation of First Coating Solution

The following composition: gas phase method silica fine particles, ion-exchanged water and a cationic resin (trade name: Sharol DC-902P, manufactured by Dai-ichi Kogyo Seiyaku Co., Ltd.) was dispersed at a rotation number of 2000 rpm for 120 minutes using a dissolver, and was further dispersed with a Daino mill disperser (filling amount of 0.65 mm zirconia beads 70%, circumferential rate 8 m/sec) to obtain a silica dispersion.

| Composition of silica dispersion | |
|---|---|
| Gas phase method silica fine particles (inorganic fine particles, an average primary particle diameter: 7 nm, trade name: Rheoseal QS-30, manufactured by Tokuyama Corp.) | 100 kg |
| Ion-exchanged water | 585.5 kg |
| Cationic resin 51.5% aqueous solution (trade name: Sharol DC-902P, manufactured by Dai-ichi Kogyo Seiyaku Co., Ltd.) | 9.7 kg |

This silica dispersion had a viscosity of 60 mPa·s, pH of 2.95 and particle diameter of 0.142 μm.

695.2 kg of the aforementioned silica dispersion, 20 kg of polyaluminium chloride (trade name: Cyrojet A200, manufactured by GRACE JAPAN K.K.) and 77.4 kg of an aqueous boric acid solution (5.30%) were mixed and stirred at a rotation number of 2000 rpm for 10 minutes. 317.2 kg of a 7% aqueous polyvinyl alcohol solution (trade name: PVA124, manufactured by Kuraray Co., Ltd.), 3.6 kg of diethylene glycol monobutyl ether, 9.3 kg of a 10% aqueous nonionic surfactant solution (trade name: Emulgen 109P, manufactured by Kao Corporation) and 0.6 kg of a fluorine surfactant (trade name: Megafac F-1405, manufactured by Dainippon Ink and Chemicals, Incorporated) were further added thereto, and the mixture was stirred at 750 rpm for 10 minutes to prepare a first coating solution for a colorant receiving layer.

The coating solution had a viscosity of 68 mPa·s, pH of 3.39, particle diameter of 0.140 μm and a surface tension of 26.7 dyn/cm.

Example 4

According to the same manner as that of Example 1 except that preparation of the first coating solution was changed as descried below, an ink-jet recording sheet (4) was prepared.

Preparation of First Coating Solution

The following composition: gas phase method silica fine particles, ion-exchanged water and an acryl type cationic polymer were dispersed at a rotation number of 2000 rpm for 120 minutes using a dissolver, and was further dispersed with a Daino mill disperser (filling amount of 0.65 mm zirconia beads 70%, circumferential rate 8 m/sec) to obtain a silica dispersion.

| Composition of silica dispersion | |
|---|---|
| Gas phase method silica fine particles (inorganic fine particles, an average primary particle diameter: 7 nm, trade name: Rheoseal QS-30, manufactured by Tokuyama Corp.) | 100 kg |
| Ion-exchanged water | 575.3 kg |
| 40% aqueous acryl type cationic polymer solution (trade name: Chemistat 7005, manufactured by Sanyo Chemical Industries, Ltd.) | 15 kg |

This silica dispersion had a viscosity of 48 mPa·s, pH of 2.95 and particle diameter of 0.135 μm.

690.3 kg of the aforementioned silica dispersion and 77.4 kg of an aqueous boric acid (5.30%) were stirred at a rotation number of 2000 rpm for 10 minutes with a dissolver. 317.2 kg of a 7% aqueous polyvinyl alcohol solution (trade name: PVA124, manufactured by Kuraray Co., Ltd.), 3.6 kg of diethylene glycol monobutyl ether, 24.9 kg of a 25% aqueous cationic polyurethane resin solution (trade name: Superflex 600, manufactured by Dai-ichi Kogyo Seiyaku Co., Ltd.), 9.3 kg of a 10% aqueous nonionic surfactant solution (trade name: Emulgen 109P, manufactured by Kao Corporation) and 0.6 kg of a fluorine surfactant (trade name: Megafac F-1405, manufactured by Dainippon Ink and Chemicals, Incorporated) were further added thereto, and the mixture was stirred at 750 rpm for 10 minutes to prepare a first coating solution for a colorant receiving layer.

The coating solution had a viscosity of 58 mPa·s, pH of 3.42, particle diameter of 0.142 μm, and a surface tension of 26.6 dyn/cm.

Comparative Example 1

According to the same manner as that of Example 1 except that a composition of the second coating solution in Example 1 was changed as described below, an ink-jet recording sheet (5) was prepared.

| Composition of second coating solution | |
|---|---|
| Ion-exchanged water | 878.2 kg |
| Boric acid | 6.5 kg |
| Aqueous ammonia (25%) | 14.0 kg |
| 2% aqueous nonionic surfactant solution (trade name: Emulgen 109P, manufactured by Kao Corporation) | 99.3 kg |
| Fluorine surfactant (trade name: Megafac F-1405, manufactured by Dainippon Ink and Chemicals, Incorporated) | 2.0 kg |

pH of a Second Coating Solution was 9.8.

Comparative Example 2

According to the same manner as that of Example 1 except that 150 kg of ammonium zirconium carbonate was changed to 150 kg of a 10% aqueous polyallylamine solution (weight average molecular weight: 15000, trade name: PAA-10C, manufactured by Nittobo) in the second coating solution in Example 1, an ink-jet recording sheet (6) was prepared.

Comparative Example 3

In preparation of the first coating solution in Example 1, a fluorine surfactant (trade name: Megafac F-1405, manufactured by Dainippon Ink and Chemicals, Incorporated)

was added, and 11 kg of zirconium acetate (trade name: Zircosol ZA, manufactured by DAIICHI KIGENSO KAGAKU KOGYO CO., LTD.) as a zirconium compound was further added to obtain a coating solution for a colorant receiving layer (second coating solution in Example 1 was not used).

This coating solution for a colorant receiving layer was used to prepare an ink-jet recording sheet as in Example 1, however cracking was remarkable, thus, a sample for evaluation could not be obtained.

Evaluation

The ink-jet recording sheets (1) to (4) of the invention as well as ink-jet recording sheets (5) to (6) of Comparative Example as obtained above were evaluated as follows:

Evaluation of Cracking

The surface of a coloring receiving layer of an ink-jet recording sheet was observed, the number of cracks in 10 centimeter square was counted, and evaluated according to the following criteria:

[Evaluation Criteria]

A: The number of cracks being 0 to 5 (being better)

B: The number of cracks being 6 to 10 (being in a practically acceptable range)

C: The number of cracks being 11 or more (without a practically acceptable range)

Evaluation of Blur with Time

Using an ink-jet printer (trade name: PM-900C, manufactured by Seiko Epson Corporation), a lattice-like line-like pattern (line width 0.28 mm) in which a magenta ink and a black ink were adjacent to each other, was printed on each ink-jet recording sheet. Immediately after printing, an already printed ink-jet recording sheet was inserted into a transparent PP file and was stored under the environment of 35° C. and a relative humidity of 80% for 3 days. Thereafter a width of black line of a line-like pattern was measured, and blur with time (%) was calculated from the measured value and a width of a black line immediately after printing which had been separately obtained, according to the following equation:

Blur with time (%)=(width of black line of line-like pattern stored under environment of 35° C. and 80% for 3 days)/(width of black line immediately after printing)×100

Evaluation of Glossiness

Using an ink-jet printer (trade name: PM-900C, manufactured by Seiko Epson Corporation), a black solid image was printed on each ink-jet recording sheet. Thereafter, using a digital angle-varying glossmeter (measuring hole: 8 mm, trade name: UGV-5D, manufactured by Suga Test Instrument Co., Ltd.), glossiness of a black solid image part was measured at an incident angle of 45 degree and a light receiving angle of 42 degree, 45 degree and 48 degree, and the glossiness was calculated by the following equation. Since when the glossiness is less than 0.06, a component of the diffused and reflected light from the surface of a recording sheet becomes smaller, the preferable glossiness like a silver salt photograph can be obtained.

Glossiness=((Glossiness at 42 degree+glossiness at 48 degree)/2)/(glossiness at 45 degree)

Evaluation of Color Density

Using an ink-jet printer (trade name: PM-900C, manufactured by Seiko Epson Corporation), solid images of yellow, magenta, cyan and black were printed, respectively, on each ink-jet recording sheet, and stored under environment of 23° C. and a relative humidity of 60% for 24 hours. Thereafter, regarding each ink-jet recording sheet, each color density was measured with a reflection concentration-meter (trade name: Xrite 938, manufactured by X-Rite Incorporated.).

Evaluation of Light Fastness

Using an ink-jet printer (trade name: PM-900C, manufactured by Seiko Epson Corporation), a solid image of magenta was printed on each ink-jet recording sheet, a lamp was illuminated under the environmental condition of a temperature of 25° C. and a relative humidity of 32% for 3.8 hours through a filter which cuts an ultraviolet-ray having a wavelength region of 365 nm or shorter and, thereafter, in the state where a lamp was switched off, a cycle of allowing to stand under the environmental condition of a temperature of 20° C. and a relative humidity of 91% for 1 hour was performed over 100 hours using "Xenon Weather-OMETER Ci65A" (trade name, manufactured by ATLAS). The magenta image concentrations before and after this test were measured with a reflection concentration-meter (trade name: Xrite 938, manufactured by X-Rite Incorporated.), and a remaining rate of magenta concentration was calculated.

TABLE 1

| Example (recording sheet No.) | | Example 1 (1) | Example 2 (2) | Example 3 (3) | Example 4 (4) | Comparative Example 1 (5) | Comparative Example 2 (6) |
|---|---|---|---|---|---|---|---|
| Cracking (piece/m$^2$) | | A | A | A | A | C | A |
| Blur with time (%) | | 151 | 160 | 145 | 141 | 180 | 150 |
| Glossiness | | 0.041 | 0.052 | 0.04 | 0.039 | 0.071 | 0.05 |
| Light resistance | | 97 | 93 | 98 | 96 | 66 | 83 |
| Color density | Y | 1.45 | 1.40 | 1.42 | 1.45 | 1.32 | 1.30 |
| | M | 1.17 | 1.15 | 1.16 | 1.16 | 1.00 | 1.15 |
| | C | 0.50 | 0.49 | 0.49 | 0.50 | 0.41 | 0.49 |
| | K | 2.49 | 2.40 | 2.42 | 2.48 | 2.10 | 2.38 |

It is seen that the ink-jet recording sheets (1) to (4) of the invention have little cracking in a colorant receiving layer, form a firm film, have little blur with time of a printed image, and are excellent in the glossiness, the color density and the light fastness. To the contrary, the ink-jet recording sheet (5) of Comparative Example 1 containing no metal compound in a second solution is inferior to the invention all in cracking, blur with time, the glossiness and the color density. In addition, it is seen that, by comparison with ink-jet recording sheets (1) to (4) and (6), the light fastness is further improved as compared with the case where polyallylamine which is one kind of an organic polymer mordant is added to a second coating solution.

The ink-jet recording sheet of the invention not only has little occurrence of cracking in a colorant receiving layer and is firm, but also has little blur with time of a printed image, and can improved the printed concentration and the glossiness of an image. In addition, the light fastness is further improved as compared with the case where an organic polymer mordant which is polyallylamine is added to a second coating solution.

What is claimed is:

1. A method for preparing an ink-jet recording sheet including a support and a colorant receiving layer disposed on the surface of the support, wherein the method comprises:

coating a coating solution including inorganic fine particles, a water-soluble resin and a boron compound on the surface of the support to form a coated layer; and cross-linking and hardening the coated layer to form a colorant receiving layer;

wherein the cross-linking and hardening is performed by applying a solution containing a metal compound and having a pH of 8 or higher to the coated layer or a coated film at a time selected from the following:

(1) at the same time as coating the coating solution;

(2) during drying of the coated layer formed by coating the coating solution and before the coated layer shows a falling rate of drying; or (3) after the coated layer formed by coating the coating solution is dried to form the coated film, wherein the inorganic fine particles are gas phase method silica having an average primary particle diameter of 20 nm or smaller, and the water-soluble resin is a polyvinyl alcohol and wherein the boron compound is included in the coating solution at a mass ratio of 0.05 to 0.50 relative to the water-soluble resin.

* * * * *